United States Patent [19]

Bilodeau

[11] 4,056,243

[45] Nov. 1, 1977

[54] APPARATUS FOR UNIFORMLY UNWINDING A YARN PACKAGE

[75] Inventor: Luc Andre Bilodeau, St. Jean, Canada

[73] Assignee: Celanese Canada Limited, Montreal, Canada

[21] Appl. No.: 673,189

[22] Filed: Apr. 2, 1976

[51] Int. Cl.[2] ..... B65H 49/00

[52] U.S. Cl. ..... 242/128

[58] Field of Search ..... 242/128, 54 R, 157 R

[56] References Cited

U.S. PATENT DOCUMENTS

| | | | |
|---|---|---|---|
| 1,547,813 | 7/1925 | Herr et al. | 242/128 |
| 1,798,980 | 3/1931 | Kayser | 242/128 |
| 2,809,791 | 10/1957 | Haworth | 242/128 |
| 3,618,873 | 11/1971 | Fons et al. | 242/128 |

*Primary Examiner*—Leonard D. Christian
*Attorney, Agent, or Firm*—Roderick B. Macleod

[57] ABSTRACT

A simple yarn unwinding apparatus which enables smooth and regular yarn unwinding of bobbins and thereby reduces yarn breakage. The apparatus comprises a bobbin of yarn mounted on a frame, a yarn take-up device for pulling the yarn from said bobbin. A light yarn guide is rotatably mounted on the frame coaxial with the bobbin and substantially frictionless upon rotation. The yarn guide is provided with a yarn passage along its axis of rotation and terminating short of the side of the bobbin opening on the yarn to gradually radially displace the yarn from the bobbin and to convey it to said yarn take-up device, while converting the motion from rotational into translational and dampening of abrupt motions of the yarn leaving the bobbin.

7 Claims, 1 Drawing Figure

APPARATUS FOR UNIFORMLY UNWINDING A YARN PACKAGE

Figure 1:
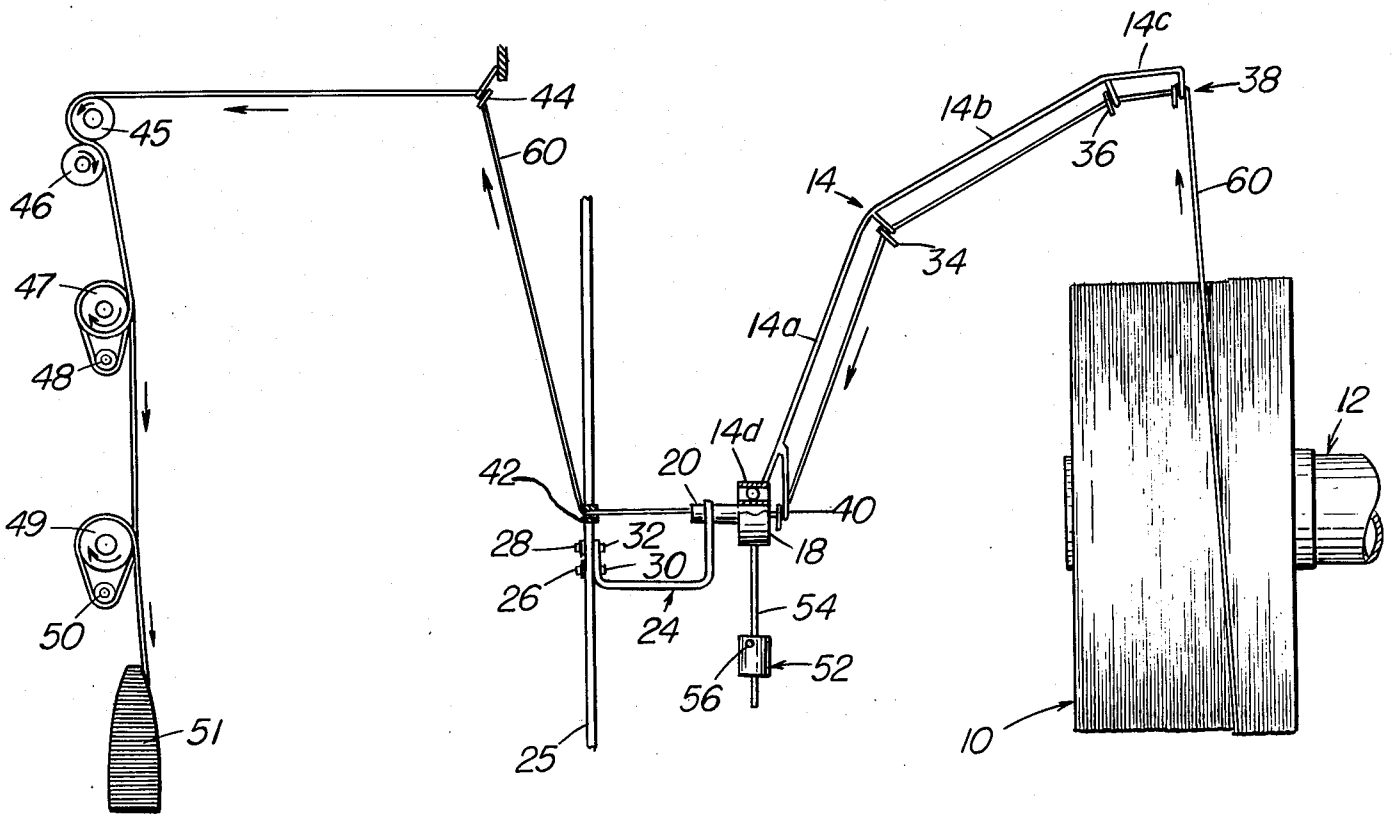

This invention relates to a yarn unwinding apparatus which enables smooth yarn delivery and particularly to a yarn unwinding apparatus having a spinning arm for guiding a yarn leaving from outside a bobbin.

It is well known to unwind bobbins of yarn from frame. However when bobbins contain irregularly wound yarn, the yarn cannot be delivered regularly, the path traced out by it is irregular and so is the tension on said yarn. All these factors contribute to increase the amount of breaks occurring during unwinding.

Broadly stated, there has now been found an apparatus for smoothly and regularly unwinding a yarn wrapped around the exterior face of a bobbin, said apparatus comprising a bobbin of yarn rigidly and substantially horizontally mounted on a frame, said bobbin containing yarn wrapped around its exterior surface, so as to be unwound from the outside of the bobbin, a yarn take-up device for pulling the yarn from said bobbin, and therebetween said take-up device and said bobbin, a light yarn guide rotatably and coaxially mounted with respect to said bobbin, and extending from its axis of rotation at one end, and at the other end to the exterior of the bobbin and ending about half-way along the length of the bobbin and at a distance short of the yarn wrapped around the bobbin, said yarn guide being substantially frictionless and being provided with a yarn passage from near said other end to said first end and said yarn guide being further provided with a yarn passage along its axis of rotation to simultaneously radially support and displace the yarn from outside of the bobbin and to convey said yarn to said yarn take-up device via said yarn passage, while simultaneously converting the motion of the yarn from rotational into translational, and by the free rotation of the yarn guide dampening of abrupt motions of the yarn leaving the bobbin, thereby reducing yarn breakage, the rotation of said yarn guide being solely obtained by the force exerted on the yarn by said take-up device.

In a preferred embodiment there has been found an apparatus for smoothly and regularly unwinding a yarn wrapped around the exterior face of a bobbin, said apparatus comprising a bobbin of yarn rigidly and substantially horizontally mounted, said bobbin containing yarn wrapped around its exterior surface, so as to be unwound from the outside of the bobbin, a yarn take-up device for pulling the yarn from said bobbin, and therebetween said take-up device and said bobbin, a tubular member secured and coaxial with said bobbin, a semi-arcuate arm being rotatably mounted, near its first end on said tubular member, and said end provided with a counter-balanced weight, the other end terminating at a distance short of the yarn wrapped around the bobbin and ending about half-way along the length of the bobbin, said arm being substantially frictionless upon rotation for its easy spinning and being provided with a yarn passage from near said other end to near said first end, said yarn passage cooperating with said tubular member defining a second yarn passage, with said yarn take-up device and with said bobbin to simultaneously radially support and displace the yarn from outside of the bobbin and to convey said yarn to said yarn take-up device via said yarn passage, while simultaneously converting the motion of the yarn from rotational into translational, and by the free rotation of the arm dampening of abrupt motions of the yarn leaving the bobbin, thereby reducing yarn breakage, the rotation of said arm being solely obtained by the force exerted on the yarn by said take-up device.

Wherever referred to throughout the disclosure and claims by yarn is meant a textile product in the form of a thread but where the filaments may require additional treatment, such as drawing, twisting, texturing and the like, or which are ready to be woven, knitted, etc. and include filaments of staple fibres, and by bobbin is meant a package of yarn wrapped around the exterior face of yarn support, said yarn being wound with some regularity along a given axis and which can be unwound, starting from the outside of said yarn support, and it includes cheeses, spools and the like.

By the expression "substantially horizontally mounted" it is meant that the bobbin may have its axis of rotation along a horizontal line or titled but exclude upwardly and substantially upwardly mounted bobbin and the expression "rigidly mounted" means that the bobbin is mounted so as to be substantially motionless during the unwinding operation.

By the expression "light yarn guide" it is meant that the guide is preferably as light as possible to reduce its moment of inertia. As a way of example only, the guide may be less than a pound and still be sufficiently strong.

In the drawing which illustrates the invention

FIG. 1 is a schematic view of a yarn unwinding apparatus encompassing a preferred embodiment of the invention, in combination with a drawing apparatus, but having a portion of the frame removed for sake of clarity.

Referring now to number 10 which designates a cheese of yarn hooked on a chuck 12 that is secured onto the frame containing a plurality of chucks and cheeses but omitted for sake of clarity. A yarn guide 14 is secured to the outer side of a sleeve **14*d*, partly shown in cross-section, itself containing a substantially frictionless bearing 18 mounted on a hollow shaft 20 and held coaxial with respect to the chuck 12 by means of a bracket 24 that is retained onto the frame partly shown 25 with nuts 26, 28 and bolts 30 – 32. Other fastening means including quick release fastening means may be used if desired to hold the shaft 20. The yarn guide 14 conveniently ends about half-way along the length of the cheese 10 to limit the displacement of the yarn from the cheese 10 to the yarn guide 14. The yarn guide 14 is conveniently semi-arcuate and made up by straight members 14*a*, 14*b* and 14*c* which may be soldered end to end, bent and is provided with pigtails 34, 36 at each junction of two members, and pigtails 38, 40 at the outer end to provide for a continuous smooth path for the yarn to be unwound from near the cheese 10 up to the axis of rotation of the bearing 18. From said bearing 18 a yarn passage is provided by the hollow shaft 20, a porcelain or stainless steel eyelet 42 mounted within the frame 25 and a yarn guide 44 leading to nip rolls 45 – 46 to the feed roller 47 and idler 48 of a yarn draw-twisting apparatus. The drawing apparatus further comprises draw roller 49, idler 50, as well as a spinning bobbin 51 and auxiliaries not shown, as is known in the art. A counter-balanced weight 52 is slidably mounted on a rod 54 and locked thereto by screw 56. The rod 54 is held diametrically opposed to the yarn guide 14 and onto the outer side of bearing 18, by soldering or other fastening means. The yarn guide 14** is thus light in weight and well balanced to offer easy spinning thereof.

OPERATING

As can be easily seen, on being unwound the yarn 56 leaves the bobbin 10 and is immediately taken up by pigtail 38 located on the yarn guide 14 which continuously turns around the cheese thereby dampening the motion of the yarn leaving the cheese and transforming the motion of the yarn from rotational into translational.

It should be borne in mind that although the invention has been illustrated with particular reference to a drawing apparatus, it is not limited thereto and may be used in combination with any other take-up apparatus where yarns need to be unwound from a package of yarn, whether it be a bobbin, a cheese and the like.

The embodiments of the invention in which an exclusive property or privilege is claimed are defined as follows:

1. An apparatus for smoothly and regularly unwinding a yarn wrapped around the exterior face of a bobbin, said apparatus comprising:

a. a frame for supporting bobbins of yarn b. a bobbin of yarn rigidly and substantially horizontally mounted on said frame, said bobbin containing yarn wrapped around its exterior surface, so as to be unwound from the outside of the bobbin, c. a yarn take-up device for pulling the yarn from said bobbin, and d. therebetween said take-up device and said bobbin, a tubular member secured on said frame and coaxial with said bobbin, e. a semi-arcuate arm being rotatably mounted, near its first end on said tubular member, and said end provided with a counter-balanced weight, the other end terminating at a distance short of the yarn wrapped around the bobbin and ending substantially half-way along the length of the bobbin, said arm being substantially frictionless upon rotation for its easy spinning and being provided with a yarn passage from near said other end to near said first end, said yarn passage co-operating with said tubular member defining a second yarn passage, with said yarn take-up device and with said bobbin to simultaneously radially support and displace the yarn from outside of the bobbin and to convey said yarn to said yarn take-up device via said yarn passages, while simultaneously converting the motion of the yarn from rotational into translational, and by the free rotation of the arm dampening of abrupt motions of the yarn leaving the bobbin, thereby reducing yarn breakage, the rotation of said arm being solely obtained by the force exerted on the yarn by said take-up device.

2. The apparatus as defined in claim 1 wherein the yarn passages are defined by a plurality of eyelets guiding said yarn.

3. The apparatus as defined in claim 1 wherein the yarn passages are defined by a plurality of pigtails guiding said yarn.

4. The apparatus as defined in claim 1 wherein the substantially yarn guide weighs less than a pound.

5. The apparatus as defined in claim 1 wherein the counter-balanced weight is adjustable.

6. The apparatus as defined in claim 1 wherein the semi-arcuated arm consists of a plurality of members joined end to end and said ends provided with a pigtail defining the yarn passage.

7. The apparatus as defined in claim 1 wherein said take-up device is a draw-twisting apparatus.

* * * * *